US006553745B2

(12) United States Patent
Tanaka et al.

(10) Patent No.: US 6,553,745 B2
(45) Date of Patent: Apr. 29, 2003

(54) HARNESS ACCOMMODATING DEVICE

(75) Inventors: Hiromi Tanaka, Tokyo (JP); Satoshi Suzuki, Tokyo (JP)

(73) Assignee: Tyco Electronics Amp, K.K., Kanagawa (JP)

( * ) Notice: Subject to any disclaimer, the term of this patent is extended or adjusted under 35 U.S.C. 154(b) by 0 days.

(21) Appl. No.: 09/841,716

(22) Filed: Apr. 25, 2001

(65) Prior Publication Data

US 2001/0036394 A1 Nov. 1, 2001

(30) Foreign Application Priority Data

Apr. 28, 2000 (JP) ..... 2000-130668

(51) Int. Cl.[7] ..... B65B 11/00
(52) U.S. Cl. ..... 53/582; 53/586
(58) Field of Search ..... 53/116, 235, 250, 53/251, 582, 586

(56) References Cited

U.S. PATENT DOCUMENTS 4,087,908 A * 5/1978 Fusco et al. ..... 29/564.4
4,551,893 A * 11/1985 Ikeda et al. ..... 29/33 M
4,838,407 A * 6/1989 Komuro ..... 198/406
5,606,909 A * 3/1997 Ohta et al. ..... 100/1
5,951,329 A * 9/1999 Kashihara ..... 174/72 A

* cited by examiner

*Primary Examiner*—Scott A. Smith
*Assistant Examiner*—Chukwurah Nathaniel

(57) ABSTRACT

The harness accommodating device (1) of the present invention is equipped with a transfer section (10) which is installed on the discharge side of the harness discharge groove (67) of the harness manufacturing apparatus (60) and which temporarily holds the harnesses (80), a chuck (20) which grips and conveys the harnesses (80) held by the transfer section (10), and a bundle receiver (30) which accommodates the harnesses (80) conveyed by the chuck (20).

19 Claims, 7 Drawing Sheets

HARNESS ACCOMMODATING DEVICE

FIELD OF THE INVENTION

The present invention relates to a harness accommodating device used to accommodate harnesses manufactured by a harness manufacturing apparatus.

BACKGROUND OF THE INVENTION

Harness manufacturing apparatuses that manufacture harnesses by connecting connectors to both end portions of electrical wires have been used in the past. The numerous harnesses manufactured by such a harness manufacturing apparatus are successively discharged into a tray, from the harness discharge part of the harness manufacturing apparatus. When these numerous harnesses are discharged into such a tray, the electrical wires of the discharged harnesses may become entangled with each other in the tray. Accordingly, the electrical wire portions of the harnesses are tied into bundles by means of a tape in order to prevent entanglement of the electrical wires with each other.

For example, the apparatus shown in FIG. 8 is known as a harness manufacturing apparatus that performs such tying into bundles (see Japanese Patent No. 2942981).

This harness manufacturing apparatus performs the tying into bundles of a plurality of harnesses 109, and is equipped with a pair of discharge guide rails 101, 102 which are used to discharge the harnesses 109. Furthermore, at the discharge ends of these discharge guide rails 101 and 102, an adhesive tape 106 is installed by means of a wrapping unit, which consists of a tape holding block 103 and a tape tensioner 104, so that this adhesive tape 106 cuts across the movement path of a plurality of electrical wires 105 gathered into bundles in a plurality of harnesses 109.

As is shown in FIG. 8(A), the plurality of electrical wires 105 gathered into bundles in a plurality of harnesses 109 move in the discharge direction through the area where the adhesive tape 106 is disposed while being caused to contact the adhesive surface of the adhesive tape 106, so that the adhesive tape adheres to the periphery of the electrical wires 105. In this case, the tip end holding part 107*a* of a tape tip end holding lever 107 is positioned on the recessed surface 103*a* of a tape holding block 103, and holds the tip end of the adhesive tape 106.

Furthermore, as the discharge of the harnesses 109 is continued, the protruding part 104*a* of the tape tensioner 104 reaches a position where it faces the recessed surface 103*a* of the tape holding block 103, as shown in FIG. 8 (B). As a result, the adhesive surfaces of the adhesive tape 106 adhere to each other, so that the tying into bundles of the electrical wires 105 that have been gathered into bundles is completed. In this case, the tape tip end holding lever 107 pivots so that the tip end holding part 107*a* is withdrawn from the recessed surface 103*a*. Then, the tape cutter 108 pivots so that it protrudes toward the tip end of the tape holding block 103, and the electrical wires 105 that have been tied into a bundle are cut away from the following adhesive tape 106. Then, the plurality of harnesses 109 in which the electrical wires 105 have been tied into a bundle are discharged to the outside, and are accommodated in a tray.

Although this is not shown in the figures, a harness manufacturing apparatus in which the suspended electrical wires can be tied into bundles for each harness by an automated process without human intervention is proposed in Japanese Utility Model Registration No. 2586251.

However, in both of these conventional harness manufacturing apparatuses, although the electrical wire portions of the harnesses can be tied into bundles, the harnesses in which the wires are thus tied into bundles are simply discharged into a tray. When the harnesses are simply discharged into a tray, the harnesses are scattered loosely inside the tray, which is extremely bothersome and inconvenient for workers who remove the harnesses from the tray and perform subsequent work. Accordingly, at the time that the harnesses are discharged, workers must constantly remove the harnesses and arrange the harnesses inside the tray. As a result, automated operation of the harness manufacturing apparatus is difficult.

SUMMARY OF THE INVENTION

An object of the present invention is to provide a harness accommodating device which is devised so that harnesses manufactured by a harness manufacturing apparatus can be accommodated by an automated process without human intervention, thus allowing automated operation of the harness manufacturing apparatus.

The harness accommodating device of the present invention is equipped with a transfer section which is installed in the harness discharge part of a harness manufacturing apparatus that manufactures harnesses by connecting connectors to both end portions of electrical wires, and which temporarily holds the aforementioned harnesses, a chuck which grips and conveys the aforementioned harnesses held by the aforementioned transfer section, and a bundle receiver which accommodates the aforementioned harnesses conveyed by the aforementioned chuck.

BRIEF DESCRIPTION OF THE DRAWINGS

FIGS. 4(A) and 4(B) illustrate the correction of the bending habit of the electrical wires by the bending habit correction device wherein FIG. 4(A) is a partial perspective view of the initial state in which the area in the vicinity of the point where the electrical wires are tied into a bundle has been inserted into the bundle-gathering member of the bending habit correction device, and FIG. 4(B) is a partial perspective view illustrating a state in which the vicinity of the point where the electrical wires are tied into a bundle has exited the bundle-gathering member of the bending habit correction device.

FIGS. 5(A) and 5(B) show explanatory diagrams of the configuration in which the harnesses are accommodated and the operation of the chuck wherein FIG. 5(A) is an explanatory diagram of the configuration in which the harnesses are accommodated, with the accommodating tray being viewed in a plan view, while FIG. 5(B) is an explanatory diagram of the operation of the chuck, with the accommodating tray likewise being viewed in a plan view.

FIGS. 6(A) and 6(B) show explanatory diagrams of the configuration in which the harnesses are accommodated and the operation of the chuck in another example wherein FIG. 6(A) is an explanatory diagram of the configuration in which the harnesses are accommodated, with the accommodating tray viewed in a plan view, and FIG. 6(B) is an explanatory diagram of the operation of the chuck, with the accommodating tray viewed in a plan view.

FIGS. 7(A–D) show explanatory diagrams of the configuration in which the harnesses are accommodated, the operation of the chuck and the operation of the accommodating trays in yet another example wherein

FIGS. 8(A) and 8(B) show a conventional example of a harness manufacturing apparatus wherein FIGS. 8(A) and 8(B) are explanatory diagrams of the bundle-tying operation of the harness manufacturing apparatus.

DETAILED DESCRIPTION OF THE PREFERRED EMBODIMENTS

Figure 1:
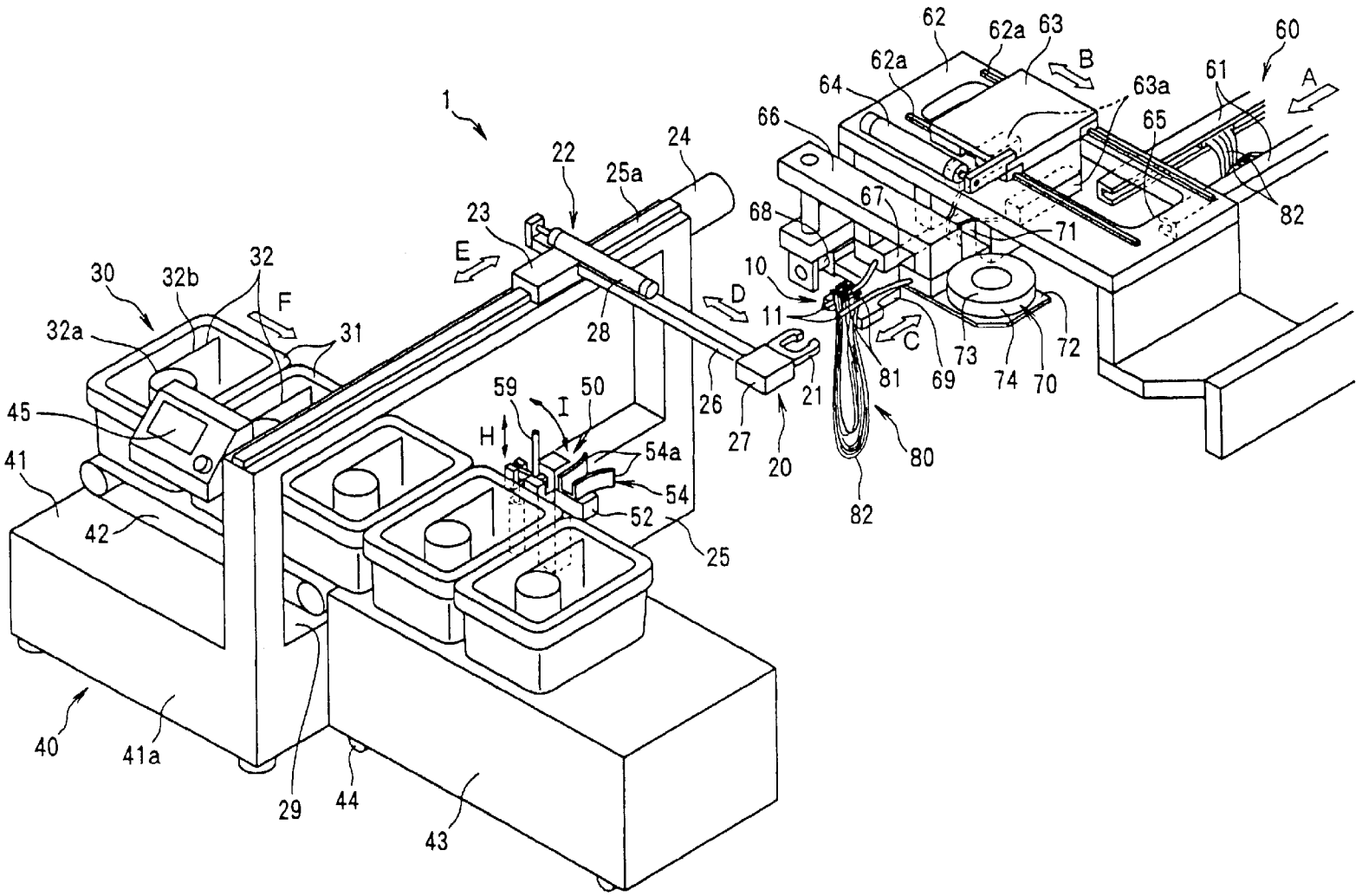
FIG. 1 is a perspective view of the harness accommodating device of the present invention.

First, the harness manufacturing apparatus 60 will be described. The harness manufacturing apparatus 60 manufactures a plurality of harnesses 80 which are formed by connecting connectors 81 to both end portions of electrical wires 82, and these harnesses 80 are tied into bundles by a bundle-tying means 70. The harnesses 80 may have a configuration in which one connector 81 each is connected to both end portions of the electrical wires 82, or a configuration in which one connector 81 is connected to one end portion of each of a plurality of electrical wires 82, and one connector that connects a plurality of electrical wires 82 is connected to the other end portions of the electrical wires 82. A plurality of harnesses 80 may be bundled together, or the operation of tying into a bundle may be performed for each individual harness 80. In FIG. 1, one harness 80 has a configuration in which one connector 81 is connected to one end portion of each of a plurality of electrical wires 82, and one connector that connects a plurality of electrical wires 82 is connected to the other end portions of these electrical wires 82. The operation of tying into a bundle is performed for each individual harness 80.

In order to perform the above-mentioned operation of tying into a bundle, the connectors 81 of the harness 80 are disposed in the pair of discharge guide rails 61 of the harness manufacturing apparatus 60 with the plurality of electrical wires 82 in a suspended state, so that the connectors 81 can move in the discharge direction as indicated by the arrow A. A harness moving member 63 which has a pair of guide parts 63*a* that are aligned with the pair of discharge guide rails 61 is disposed on a base 62 at the discharge ends of the pair of discharge guide rails 61. This harness moving member 63 is constructed so that it can be moved in the direction indicated by arrow B perpendicular to the discharge direction by a cylinder 64 along a pair of rails 62*a* on the base 62, and is arranged so that the guide parts 63*a* are aligned with the discharge ends of the discharge guide rails 61 via an opening 65 formed in the base 62.

Figure 2:
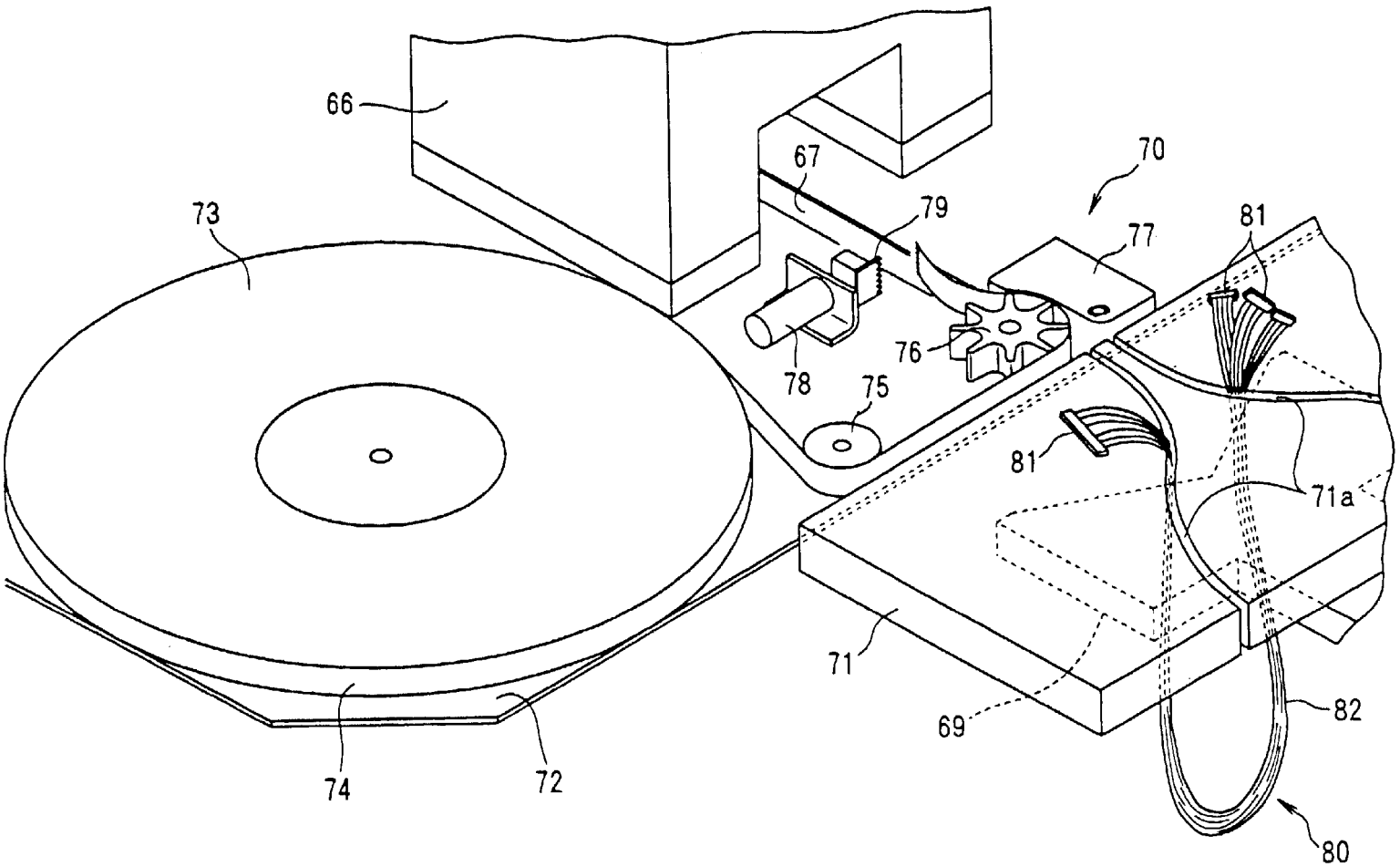
FIG. 2 is an enlarged perspective view in which the bundle-tying means of the harness manufacturing apparatus is seen from a different direction than in FIG. 1.

An electrical wire bundle-gathering member 71 which is used to gather the electrical wires 82 of each harness 80 into a bundle is disposed at the discharge end of the base 62. This electrical wire bundle-gathering member 71 is positioned in a position that is aligned with the guide parts 63*a* of the harness moving part 63 when these guide parts 63*a* are positioned in the positions most distant from the discharge guide rails 61. As is shown most clearly in FIG. 2, a curved guide groove 71*a* which is used to gather the electrical wires 82 of each harness 80 into a bundle is formed in the electrical wire bundle-gathering member 71 so that this guide groove 71*a* extends in the discharge direction from the edge of the entry end of the electrical wire bundle-gathering member 71 to the edge of the discharge end.

A bundle-tying means 70 which is used to tie the bundles of the harnesses 80 gathered into bundles by the electrical wire bundle-gathering member 71 is installed at the discharge end of the electrical wire bundle-gathering member 71. This bundle-tying means 70 has a unit base part 72 which is attached to the lower end of a support member 66. A harness discharge groove 67 through which the electrical wires 82 of the harnesses 80 that have been gathered into bundles can pass is formed in the unit base part 72 so that this discharge groove 67 extends in the discharge direction from the edge of the entry end of the unit base part 72 to the edge of the discharge end. This harness discharge groove 67 forms a harness discharge part. A tape reel 73 around which a bundle-tying tape 74 is wrapped, a bonding roller 76 which bonds the bundle-tying tape 74 around the periphery of the electrical wires 82 that have been gathered into a bundle, and a receiver 77 which is installed facing the bonding roller 76 with the harness discharge groove 67 located in between, are disposed on the unit base part 72. Furthermore, a cutting device 79 which cuts the bundle-tying tape 74 that has been applied by the bonding roller 76 is disposed on the unit base part 72. This cutting device 79 is caused to advance and withdraw in a direction that crosses the harness discharge groove 67 by a cylinder 78.

A transfer section 10 formed by a pair of bar members 11 that possess elasticity is formed so that these bar members 11 protrude from the end surface of the support member 66 at the discharge end of the harness discharge groove 67. The spacing of the pair of bar members 11 that form this transfer section 10 is set so that it is substantially equal to the width of the harness discharge groove 67, thus providing elastic support of the portion of the bundled harness located in the vicinity of the point where the harness has been tied into a bundle (i.e., the area of the bundle-tying tape 74).

A harness conveyor 69 which can be caused to move by a cylinder 68 in the direction indicated by the arrow C, and which moves the harnesses 80 in the discharge direction, is disposed beneath the unit base part 72. This harness conveyor 69 is formed so that it can perform a reciprocating motion from the rear ends of the guide parts 63*a* of the harness moving member 63 to substantially the central portion of the transfer section 10.

Next, the operation in which the harnesses 80 are tied into bundles and held by the transfer section 10 will be described. First, when the guide parts 63*a* of the harness moving member 63 are aligned with the discharge guide rails 61, a given harness 80 is caused to move in the discharge direction indicated by the arrow A from the discharge guide rails 61, and is held by the guide parts 63*a*. Subsequently, the harness moving member 63 moves together with the harness 80 in the direction indicated by the arrow B, which is perpendicular to the discharge direction, as shown in FIG. 1. In this case, the harness conveyor 69 is positioned beneath the rear ends of the guide parts 63*a* of the harness moving member 63. From this state, the harness conveyor 69 moves in the direction indicated by the arrow C while pushing the harness 80, and when [the harness conveyor 69] passes through the electrical wire bundle-gathering member 71, the electrical wires 82 of the harness 80 are conveyed by the harness conveyor 69 and positioned inside the harness discharge groove 67 while being guided by the guide groove 71*a* of the electrical wire bundle-gathering member 71. Then, when the harness conveyor 69 moves in the harness discharge direction in this state, the bundle-tying tape 74 is bonded to the periphery of the bundled electrical wires 82 by the bonding roller 76, and the unnecessary bundle-tying tape 74 is cut by the cutting device 79, so that the tying of the harness 80 into a bundle is completed. Then, when the harness conveyor 69 moves further in the discharge direction so that the harness 80 is discharged from the harness discharge groove 67, the harness 80 that has been tied into a bundle is held by the transfer section 10 in the vicinity of the portion of the harness 80 where the electrical wires 82 have been tied into a bundle.

Next, the construction of the harness accommodating device 1 will be described. The harness accommodating device 1 is equipped with the aforementioned transfer section 10, a chuck 20 which grips and conveys the harnesses 80 that have been tied into bundles and held by the transfer section 10, and a bundle receiver 30 which accommodates the bundled harnesses 80 that have been conveyed by the chuck 20.

Among these parts, the chuck 20 is equipped with a harness chuck 21 that grips the harnesses 80, and a transporter 22 that moves this harness chuck 21 toward the bundle receiver 30. This transporter 22 is equipped with a first moving member 23 which can move in the direction indicated by the arrow E over a rail 25*a* that extends in the direction indicated by the arrow, and a second moving member 26 which is attached to the first moving member 23 so that this second moving member 26 can move in the direction indicated by the arrow D. A chuck attachment member 27 to which the chuck 21 is attached is disposed on the tip end of the second moving member 26. The first moving member 23 is caused to move in the direction indicated by the arrow E by a conversion means such as a ball screw, etc., that converts the rotation of the rotating shaft of a motor 24 into linear motion in the direction indicated by the arrow E. Furthermore, the second moving member 26 is arranged so that it is caused to move between two positions in the direction indicated by the arrow D by a cylinder 28. The second moving member 26 is not limited to movement between two positions in the direction indicated by the arrow D effected by means of a cylinder 28. This member may also be devised so that it can be stopped at arbitrary positions in the direction indicated by the arrow D using some other type of moving mechanism.

Furthermore, the bundle receiver 30 is formed by box-type accommodating trays 31 that have a partition plate 32 inside. A plurality of these accommodating trays 31 are lined up side by side, and are installed so that these accommodating trays 31 can move in the direction indicated by the arrow F over a bundle receiver moving device 40. In the embodiment shown in FIG. 1, each partition plate 32 is formed by a tubular plate part 32*a* and a rectilinear plate part 32*b* that extends tangentially from this tubular plate part 32*a*. The rectilinear plate part 32*b* extends from the left portion of the circumferential surface of the tubular plate part 32*a*.

The bundle receiver moving device 40 consists of a fixed part 41 on which a belt conveyor 42 that moves the accommodating trays 31 in the direction indicated by the arrow is disposed, and a movable part 43 which is disposed adjacent to the fixed part 41. The fixed part 41 has the belt conveyor 42 disposed on its upper surface, and consists of a pedestal part 41*a* which is installed so that it does not move with respect to the floor surface, and an upright part 25 which extends forward from this pedestal part 41*a*. The rail 25*a* extends in the direction indicated by the arrow E on the upper end surface of the upright part 25. Furthermore, an opening 29 which is arranged so that the accommodating trays 31 can be moved over the movable part 43 by the belt conveyor 42 on the fixed part 41 is formed in the upright part 25. A plurality of casters 44 are installed on the undersurface of the movable part 43, so that the movable part 43 can move with respect to the floor surface. Moreover, in FIG. 1, 45 indicates a control panel which is used to control the driving of the first moving member 23, second moving member 26 and belt conveyor 42.

Figure 3:
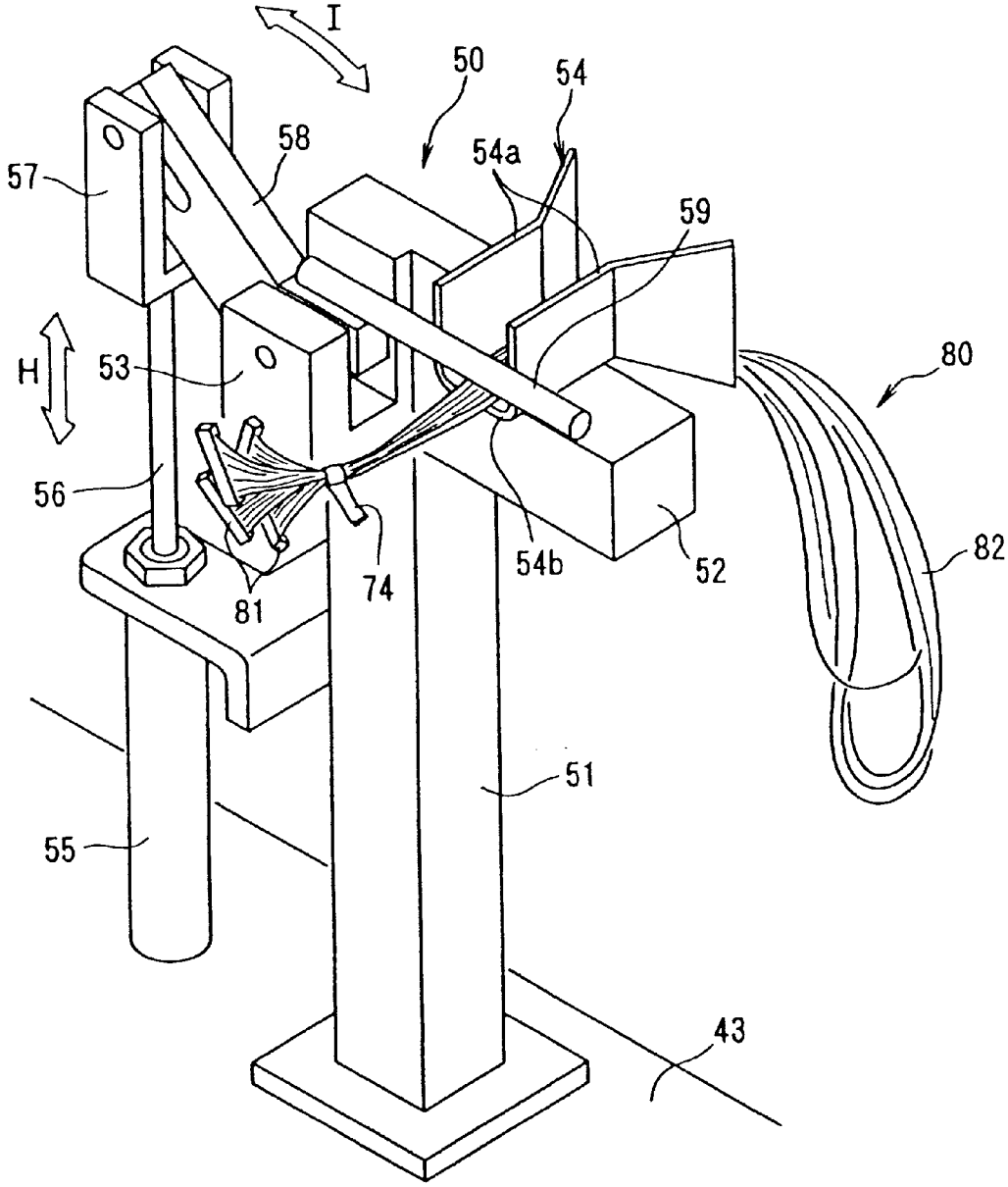
FIG. 3 is an enlarged perspective view of the bending habit correction device of the harness accommodating device.

A bending habit correction device 50 which corrects the bending habit of the electrical wires 82 of each harness 80 before the harness 80 is accommodated in the bundle receiver 30 is disposed on the movable part 43 between the transfer section 10 and the bundle receiver 30. In this bending habit correction device 50, as is shown most clearly in FIG. 3, a bundle-gathering part carrying base part 52 and an raking part pivoting base part 53 are disposed on the upper end of a columnar member 51 which is disposed in an upright position on the upper surface of the movable part 43. A bundle-gathering member 54 which gathers the electrical wires 82 that have a bending habit into a bundle is fastened to the surface of the bundle-gathering part carrying base part 52. This bundle-gathering member 54 has a pair of bundle-gathering plate parts 54*a* which gather the electrical wires 82 that are spread out in the lateral direction into a bundle in the center, and a bottom wall 54*b* which connects the bottom ends of these bundle-gathering plate parts 54*a*. Each bundle-gathering plate part 54*a* has an oblique surface part that is inclined inward from the outside toward the inside in the lateral direction along the discharge direction of the harness 80, and a parallel surface part that extends parallel to the discharge direction from the oblique surface part. Furthermore, in the raking part pivoting base part 53, the tip end portion of a pivoting member 58 which has an raking rod member 59 attached to its tip end is shaft-supported so that this tip end portion can pivot in the direction indicated by the arrow I. The rear end portion of the pivoting member 58 is shaft-supported on an attachment member 57 which is installed on the upper end of the piston rod 56 of a cylinder 55, so that this rear end portion can pivot. The piston rod 56 of the cylinder 55 is constructed so that it can move upward and downward in the direction indicated by the arrow H. Accordingly, when the piston rod 56 moves upward, the upward movement of the attachment member 57 causes the tip end portion of the pivoting member 58 to pivot downward about the supporting shaft, so that the raking rod member 59 attached to this pivoting member 58 also pivots downward. Conversely, when the piston rod 56 moves downward, the downward movement of the attachment member 57 causes the tip end portion of the pivoting member 58 to pivot upward about the supporting shaft, so that the raking rod member 59 attached to this pivoting member 58 also pivots upward.

Figure 4A:
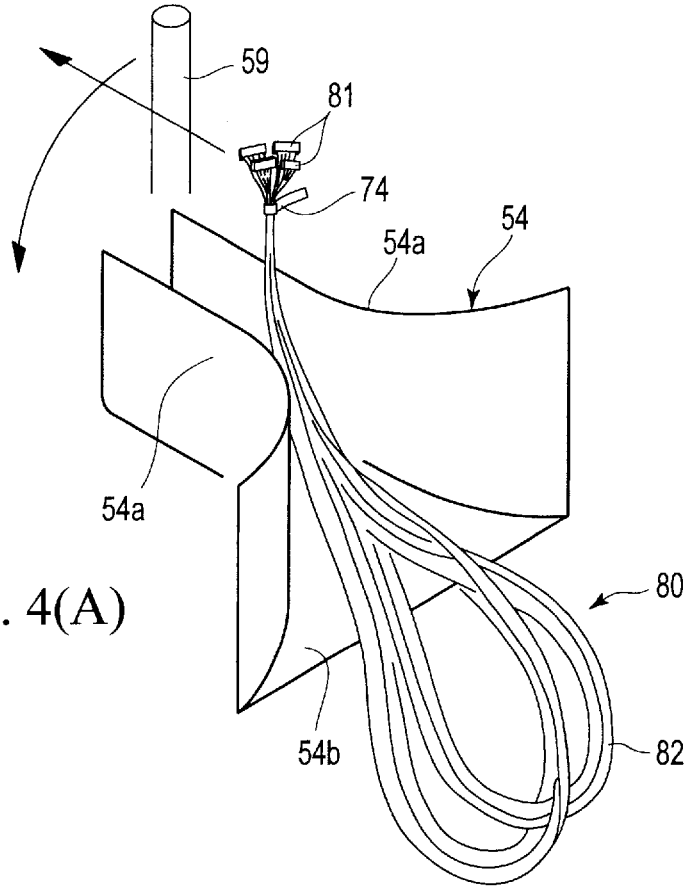
Figure 4B:
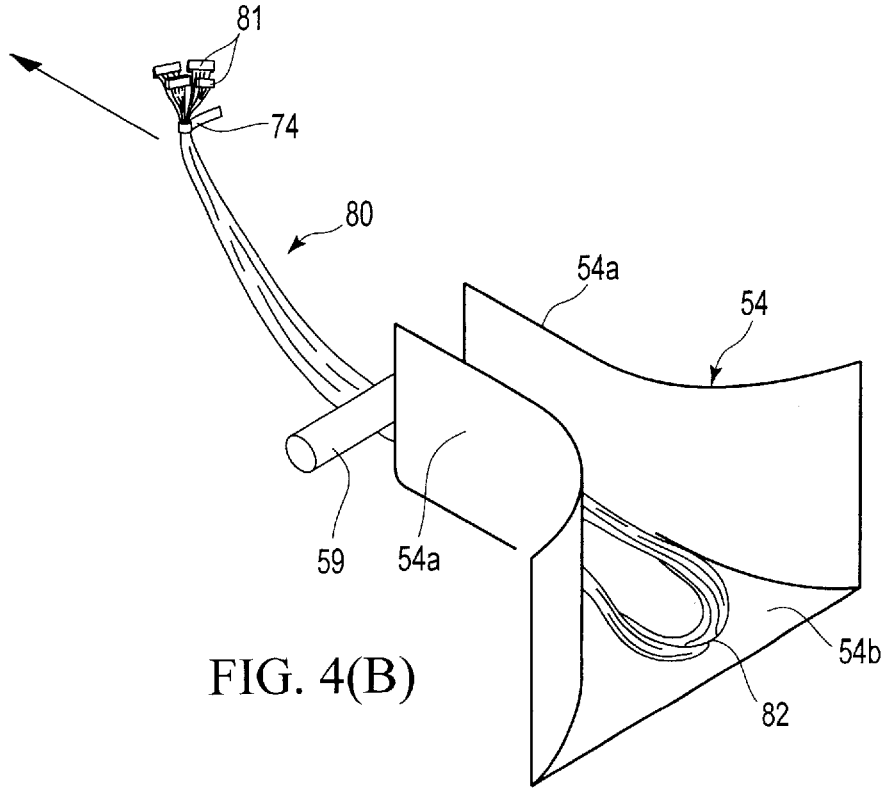

Next, the method by which the harnesses 80 are accommodated in the accommodating trays 31 by the harness accommodating device 1 will be described with reference to FIG. 1 and FIGS. 3 through 5. First, as is shown in FIG. 1, in a state in which a harness 80 is held by the transfer section 10, the harness chuck 21 is caused to move in the opposite direction from the discharge direction by the first moving member 23, so that the harness chuck 21 enters the space between the connectors 81 of the harness 80 and the transfer section 10, and grips the electrical wires 82. Afterward, the first moving member 23 moves in the discharge direction while maintaining a state in which the harness chuck 21 grips the electrical wires 82 of the harness 80, so that the vicinity of the area where the electrical wires 82 are tied into a bundle enters the bundle-gathering member 54 of the bending habit correction device 50 as shown in FIG. 4(A). In this case, the portions of the electrical wires 82 that have a bending habit are gathered into a bundle in the center by the oblique surface parts of the bundle-gathering plate parts 54*a* while these portions of the electrical wires 82 contact the bottom wall 54*b* of the bundle-gathering member 54. In this state, the raking rod member 59 is in a position which is such that the tip end of the raking rod member 59 faces upward. Then, when the first moving member 23 moves further in the discharge direction so that the vicinity of the area where the electrical wires 82 are tied into a bundle exits the bundle-gathering member 54, the raking rod member 59 pivots downward as a result of the upward movement of the piston rod 56 while the portions of the electrical wires 82 that have a bending habit move between the parallel surface parts of the bundle-gathering plate parts 54*a*, so that the portions of the electrical wires 82 that have a bending habit are raked from above by the raking rod member 59 as shown in FIG. 4(B). As a result, the bending habit of these portions of the electrical wires 82 that have a bending habit is corrected.

Figure 5A:
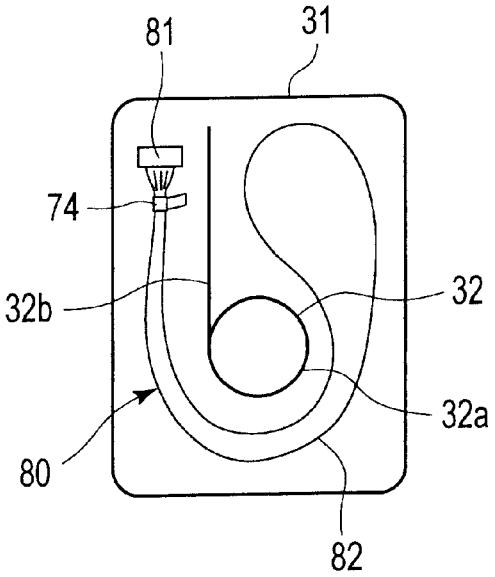
Figure 5B:
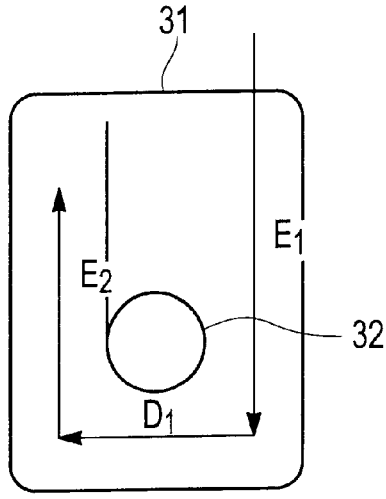

When the first moving member 23 is caused to move further in the discharge direction indicated by the arrow E1 in FIG. 5(B) after the portions of the electrical wires 82 that have a bending habit have been corrected, the electrical wires 82 of the harness 80 ride over the outer wall of the corresponding accommodating tray 31, and are placed on the bottom surface of the accommodating tray 31 located on the right side of the rectilinear plate part 32*b* of the partition plate 32. Prior to the movement of the first moving member 23, the corresponding accommodating tray 31 is pre-positioned in the accommodating position on the movable part 43 by the driving of the belt conveyor 42. Then, when the cylinder 28 is operated so that the second moving member 26 is caused to move to the left indicated by the arrow D1 in FIG. 5(B), the electrical wires 82 of the harness 80 are further placed on the bottom surface of the accommodating tray 31 so that these wires 82 are wrapped around the tubular plate part 32*a* of the partition plate 32. Then, when the first moving member 23 is caused to move in the opposite direction from the discharge direction indicated by the arrow E2 in FIG. 5(B), the electrical wires 82 of the harness 80 are further placed on the bottom surface of the accommodating tray 31 located on the left side of the rectilinear plate part 32*b* of the partition plate 32. When the grip of the harness chuck 21 is released in this state, the connectors 81 of the harness 80 are also placed on the bottom surface of the accommodating tray 31 on the left side of the rectilinear plate part 32*b* as shown in FIG. 5(A). In this accommodating state, the connectors 81 of the harness 80 and the loop portions of the electrical wires 82 are separated by the rectilinear plate part 32*b*, so that entanglement of these parts is prevented. Furthermore, the electrical wires 82 of the harness 80 are placed so that they are wrapped around the tubular plate part 32*a*. Consequently, the electrical wires 82 are carried in a state that is close to the natural state of the electrical wires 82. Accordingly, when a worker removes the harnesses 80 from the accommodating tray 31, this removal work is simplified.

Furthermore, when the above-mentioned accommodating operation is repeated for a plurality of harnesses 80 that have been tied into bundles, these harnesses 80 that have been tied into bundles are accommodated inside the accommodating tray 31 in a state in which the connectors 81 and electrical wires 82 are more or less aligned in the vertical direction. Accordingly, the harnesses 80 manufactured by the harness manufacturing apparatus 60 can be accommodated in the accommodating trays 31 an automated process without human intervention.

After a specified number of harnesses 80 have been accommodated in one accommodating tray 31, the belt conveyor 42 is driven in the direction indicated by the arrow F, thus positioning an accommodating tray 31 in which no harnesses have yet been accommodated in the accommodating position on the movable part 43. Accordingly, a plurality of harnesses 80 manufactured by the harness manufacturing apparatus 60 can be accommodated inside a plurality of accommodating trays 31 by an automated operation without human intervention, so that automated operation of the harness manufacturing apparatus 60 is made possible. Then, the accommodating trays 31 in which a plurality of harnesses 80 that have been tied into bundles are accommodated are carried by workers to a specified location for subsequent work.

Furthermore, since the movable part 43 of the bundle receiver moving device 40 is movable, this movable part 43 can be moved to a different location so that workers can perform work in the empty space left by the movable part 43 in cases where the harness manufacturing apparatus 60 is operated by a manned operation.

Figure 6A:
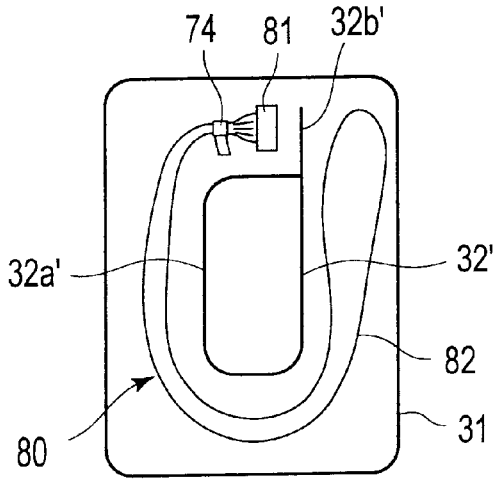

Next, another example of the configuration in which the harnesses 80 are accommodated, and of the operation of the chuck, will be described with reference to FIGS. 6 and 7. Referring to FIG. 6(A), it will be seen that the shape of the partition plate 32' installed in each accommodating tray 31 differs from the shape of the partition plate 32 shown in FIG. 5(A). This partition plate 32' is formed by a substantially rectangular tubular plate part 32*a'*, and a rectilinear plate part 32*b'* that extends in a straight line from this substantially rectangular tubular plate part 32*a'*. The rectilinear plate part 32*b'* is formed by extending the right-side rectilinear portion of the substantially rectangular tubular part 32*a'*.

Figure 6B:
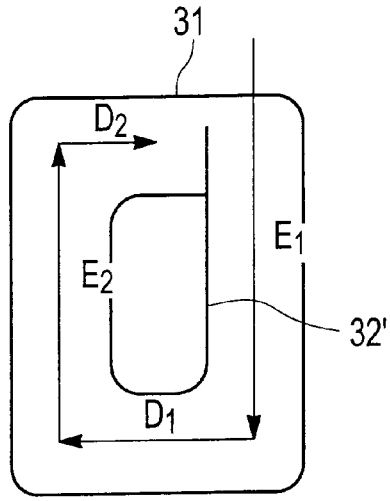

When the first moving member 23 is caused to move further in the discharge direction indicated by the arrow E1 in FIG. 6(B) after the portions of the electrical wires 82 that have a bending habit have been corrected by the bending habit correction device 50, the electrical wires 82 of the harness 80 ride over the outer wall of the corresponding accommodating tray 31, and are placed on the bottom surface of the accommodating tray 31 located on the right side of the rectilinear plate part 32*b'* of the partition plate 32'. Prior to the movement of the first moving member 23, the corresponding accommodating tray 31 is pre-positioned in the accommodating position on the movable part 43 by the driving of the belt conveyor 42. Then, when the cylinder 28 is operated so that the second moving member 26 is caused to move to the left in the direction perpendicular to the discharge direction indicated by the arrow D1 in FIG. 6(B), the electrical wires 82 of the harness 80 are further placed on the bottom surface of the accommodating tray 31 located on the near side of the substantially rectangular tubular plate part 32*a'* of the partition plate 32'. Then, when the first moving member 23 is caused to move further in the direction opposite from the discharge direction indicated by the arrow E2 in FIG. 6(B), the electrical wires 82 of the harness 80 are further placed on the bottom surface of the accommodating tray 31 located on the left side of the substantially rectangular tubular plate part 32*a'* of the partition plate 32'. Then, when the second moving member 26 is caused to move to the right in the direction perpendicular to the discharge direction indicated by the arrow D2 so that the harness chuck 21 is caused to move in the direction indicated by the arrow D2 for a distance that is shorter than the distance moved in the direction indicated by the arrow D1, the electrical wires 82 of the harness 80 are placed on the bottom surface of the accommodating tray 31 located on the other side of the substantially rectangular tubular plate part 32*a*' of the partition plate 32' that is on the opposite side from the near side of the substantially rectangular tubular plate part 32*a*'. When the grip of the harness chuck 21 is released in this state, the connectors 81 of the harness 80 are also placed on the bottom surface of the accommodating tray 31 on the other side of the substantially rectangular tubular plate part 32*a*' as shown in FIG. 6(A). In this state, as in the state shown in FIG. 5(A), the connectors 81 of the harness 80 and the loop portions of the electrical wires 82 are separated by the rectilinear plate part 32*b*', so that entanglement of these parts is prevented. Furthermore, since the electrical wires 82 of the harness 80 are carried in a state that is close to the natural state of these electrical wires 82, the removal work is simplified when workers remove the harnesses 80 from the accommodating trays 31.

Furthermore, in cases where the second moving member 26 can only adopt two positions, the grip of the harness chuck 21 may be released at an intermediate point during the movement of the harness chuck 21 in the direction indicated by the arrow D2.

Furthermore, when the above-mentioned accommodating operation is repeated for a plurality of harnesses 80 that have been tied into bundles, these harnesses 80 that have been tied into bundles are accommodated inside the accommodating tray 31 in a state in which the connectors 81 and electrical wires 82 are more or less aligned in the vertical direction. Accordingly, the harnesses 80 manufactured by the harness manufacturing apparatus 60 can be accommodated in the accommodating trays 31 by an automated process without human intervention.

Figure 7A:
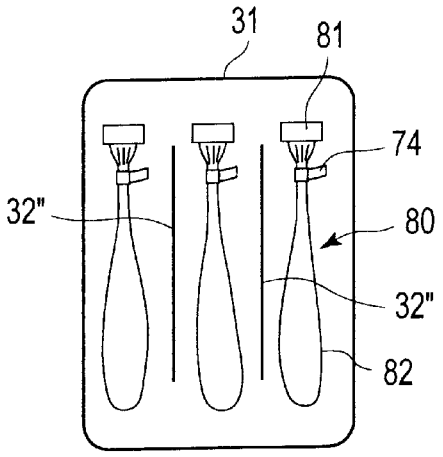
FIG. 7(A) is an explanatory diagram of the configuration in which the harnesses are accommodated, with the accommodating tray viewed in a plan view.

Referring to FIG. 7(A), it will be seen that the shape of the partition plates 32" installed inside each accommodating tray 31 differs from that of the partition plate 32 shown in FIG. 5(A) and that of the partition plate 32' shown in FIG. 6(A). Each of these partition plates 32" is formed by a rectilinear plate part that extends in a straight line in the discharge direction of the harnesses 80. The two partition plates 32" in each accommodating tray 31 are disposed at a specified spacing in the direction perpendicular to the discharge direction.

Figure 7B:
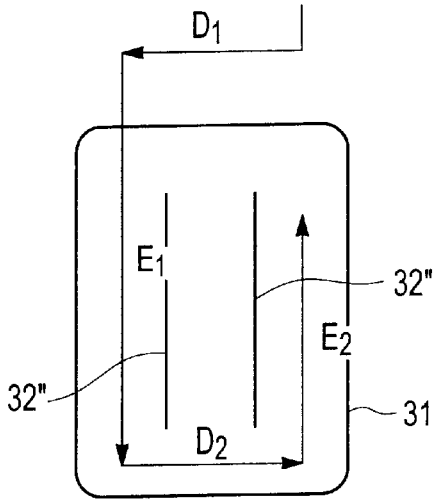
FIGS. 7(B), 7(C) and 7(D) are explanatory diagrams of the operation of the chuck and accommodating trays, with one of the accommodating trays viewed in a plan view.
Figure 7C:
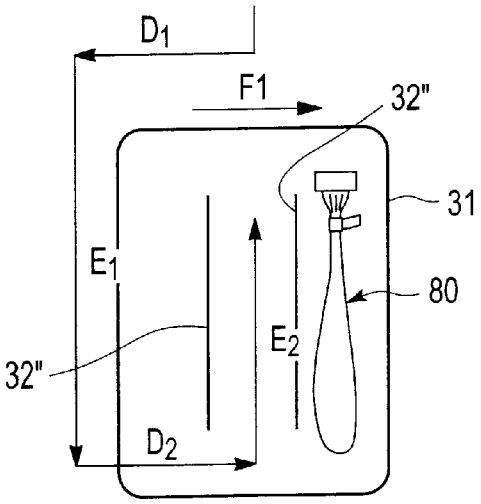

After the portions of the electrical wires 82 that have a bending habit have been corrected by the bending habit correction device 50, the second moving member 26 is caused to move to the left in the direction perpendicular to the discharged direction as indicated by the arrow D1 in FIG. 7(B)) so that the harness chuck 21 is caused to move in the same direction, and the first moving member 23 is caused to move in the discharge direction so that the harness chuck 21 is caused to move in the direction indicated by the arrow E1, as is shown in FIG. 7(B). Afterward, the second moving member 26 is caused to move in the direction indicated by the arrow D2, so that the harness chuck 21 is caused to move in the direction indicated by the arrow D2, and the first moving member 23 is caused to move in the direction indicated by the arrow E2, which is the opposite of the direction indicated by the arrow E1, so that the harness chuck 21 is caused to move in the direction indicated by the arrow E2. Then, the gripping of the harness 80 by the harness chuck 21 is released. As a result, the harness 80 is placed on the bottom surface of the accommodating tray 31 located on the right side of the right-side partition plate 32" as shown in FIGS. 7(A) and 7(C). In this case, the connectors 81 of the harness 80 are placed on the opposite side from the near side.

Afterward, as is shown in FIG. 7(C), the belt conveyor 42 is driven so that the corresponding accommodating tray 31 is caused to move a specified distance preferably, a distance equal to ⅓ the width of the accommodating tray 31 in the direction indicated by the arrow F1. In this state, the second moving member 26 is caused to move in the direction indicated by the arrow D1, so that the harness chuck 21 gripping a fresh harness 80 is caused to move in the direction indicated by the arrow D1. Furthermore, the first moving member 23 is caused to move in the discharge direction as indicated by the arrow E1 in FIG. 7(C)) so that the harness chuck 21 is caused to move in the same direction. Afterward, the second moving member 26 is caused to move in the direction indicated by the arrow D2, so that the harness chuck 21 is caused to move in the direction indicated by the arrow D2. The first moving member 23 is caused to move in the direction indicated by the arrow E2, so that the harness chuck 21 is caused to move in the same direction indicated. Then, the gripping of the harness 80 by the harness chuck 21 is released. As a result, the harness 80 is placed on the bottom surface of the accommodating tray 31 located between the left and right partition plates 32" as shown in FIGS. 7(A) and 7(D) In this case, the connectors 81 of the harness 80 are placed on the opposite side from the near side.

Figure 7D:
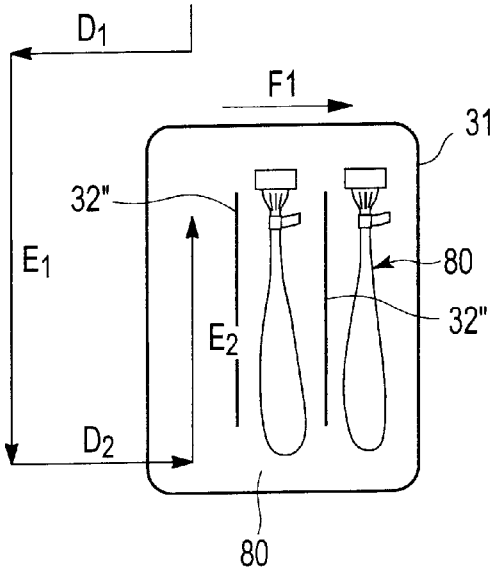
Figure 8A:
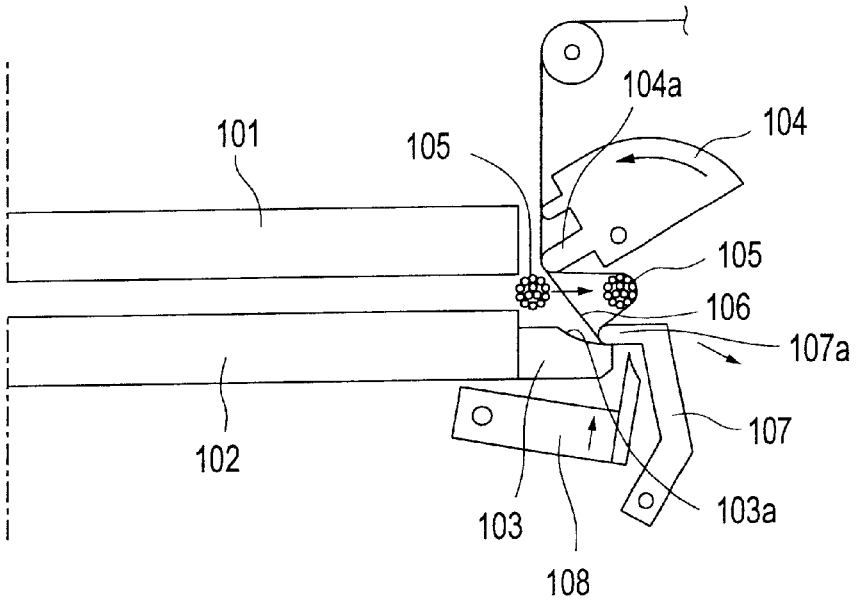
FIG. 8(A) PRIOR ART
Figure 8B:
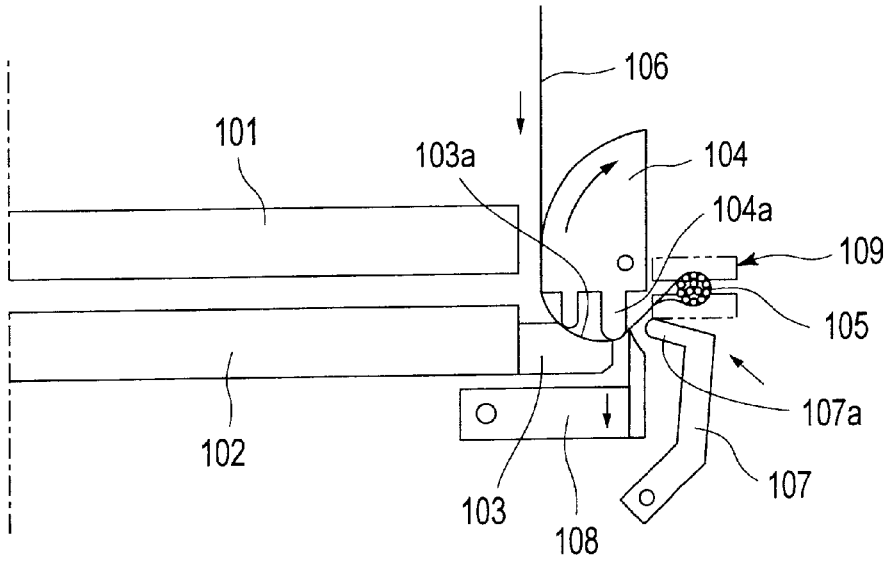
FIG. 8(B) PRIOR ART

Next, as is shown in FIG. 7(D), the belt conveyor 42 is driven so that the corresponding accommodating tray 31 is caused to move a further specified distance in the direction indicated by the arrow F1. In this state, the second moving member 26 is caused to move in the direction indicated by the arrow D1, which is perpendicular to the discharge direction, so that the harness chuck 21 gripping a fresh harness 80 is caused to move in the direction indicated by the arrow D1. The first moving member 23 is caused to move in the discharge direction as indicated by the arrow E1 in FIG. 7(D)) so that the harness chuck 21 is caused to move in the same direction. Afterward, the second moving member 26 is caused to move in the direction indicated by the arrow D2, so that the harness chuck 21 is caused to move in the same direction. Furthermore, the first moving member 23 is caused to move in the direction indicated by the arrow E2 so that the harness chuck 21 is caused to move in the same direction. Then, the gripping of the harness 80 by the harness chuck 21 is released. As a result, the harness 80 is placed on the bottom surface of the accommodating tray 31 located on the left side of the left-side partition plate 32" as shown in FIG. 7(A). In this case, the connectors 81 of the harness 80 are placed on the opposite side from the near side.

When the above-mentioned accommodating operation is repeated, a plurality of harnesses 80 that have been tied into bundles are accommodated in three rows inside the accommodating tray 31 in a state in which the connectors 81 and electrical wires 82 are more or less aligned in the vertical direction. Accordingly, the harnesses 80 manufactured by the harness manufacturing apparatus 60 can be accommodated in the accommodating trays 31 by an automated process without human intervention.

As is shown in FIGS. 7(B) through 7(D), the movement path of the first moving member 23 is set in a roundabout manner as the same path leading to the position where the harness 80 is to be accommodated. As a result, the electrical wires 82 in the intermediate portion of each harness 80 can be securely placed on the opposite side from the connectors

81. Entanglement of harnesses 80 in motion with harnesses 80 already accommodated in the accommodating tray 31 can be prevented, and the program that designates the movement path of the first moving member 23 can be simplified.

Embodiments of the present invention have been described above. However, the present invention is not limited to these embodiments. Various alterations are possible. For example, the accommodation operation of the harnesses 80 in the accommodating trays 31 is not limited to the operation shown in FIGS. 5 through 7 as various other configurations may be adopted.

What is claimed is:

1. A harness accommodating device, comprising:

a transfer section which is installed in a harness discharge part of a wire harness manufacturing apparatus and which temporarily holds harnesses within the apparatus;

a chuck which grips and conveys the harnesses held by the transfer section; and a bundle receiver which accommodates the harnesses conveyed by the aforementioned chuck, the bundle receiver is mounted so that the bundle receiver can move over a bundle receiver moving device consisting of a fixed part on which a moving device that causes the aforementioned bundle receiver to move is disposed and a movable part which is adjacent to the aforementioned fixed part.

2. The harness accommodating device claimed in claim 1, wherein the transfer section temporarily holds harnesses that have been tied into bundles, the chuck grips and conveys the harnesses tied into bundles that are held by the transfer section, and the bundle receiver accommodates the harnesses tied into bundles that are conveyed by the chuck.

3. The harness accommodating device claimed in claim 1, wherein the bundle receiver is formed by accommodating trays, each equipped with a partition plate which has a tubular plate part and a rectilinear plate part that extends from this tubular plate part.

4. The harness accommodating device claimed in claim 3, further comprising a bending habit correction device disposed between the transfer section and the bundle receiver.

5. The harness accommodating device claimed in claim 4, further comprising a bundle-gathering member having plate parts that gather electrical wires of the harnesses.

6. The harness accommodating device claimed in claim 4, further comprising a raking rod member that corrects bends in electrical wires of the harnesses.

7. The harness accommodating device claimed in claim 6, wherein the raking rod member is driven by a piston rod.

8. The harness accommodating device claimed in claim 3, wherein the harnesses are placed in the tray so that electrical wires of the harnesses are wrapped around the tubular plate part of the partition plate.

9. The harness accommodating device claimed in claim 1, wherein the bundle receiver accommodates the harnesses such that a connector part of the harness is separated from a loop portion of electrical wires of the harness.

10. The harness accommodating device claimed in claim 1, wherein the bundle receiver is formed by accomodating trays, each equipped with at least one partition plate.

11. The harness accommodating device claimed in claim 10, wherein electrical wires of the harnesses are separated by the partition plate.

12. A harness accommodating device, comprising:

a transfer section which is installed in a harness discharge part of a wire harness manufacturing apparatus and which temporarily holds harnesses within the apparatus;

a chuck which grips and conveys the harnesses held by the transfer section;

a bundle receiver which accommodates the harnesses conveyed by the aforementioned chuck; and the chuck has a first moving member enabling the chuck to move perpendicular to the bundle receiver and a second moving member enabling the chuck to move parallel to the bundle receiver.

13. A harness accommodating device, comprising:

a bundle receiver that accommodates a plurality of harnesses; and a chuck that grips the harnesses discharged from a wire harness manufacturing apparatus and positions the harnesses in the bundle receiver so that a connector part of the harnesses is separated from a loop portion of the harnesses by a partition.

14. The harness accommodating device claimed in claim 13, further comprising a bundle-gathering member having plate parts that gather electrical wires of the harnesses before the chuck positions the harnesses in the bundle receiver.

15. The harness accommodating device claimed in claim 14, wherein the bundle-gathering member includes a raking rod member that corrects bends in the electrical wires of the harnesses.

16. The harness accommodating device claimed in claim 15, wherein the raking rod member is driven by a piston rod.

17. The harness accommodating device claimed in claim 13, wherein the partition includes a plate member and a tubular member, and electrical wires of the harnesses are wrapped around the tubular member.

18. The harness accommodating device claimed in claim 13, further comprising a bundle receiver moving device that positions the bundle receiver adjacent to the chuck.

19. The harness accommodating device claimed in claim 18, wherein the bundle receiver is a harness accommodating tray.

* * * * *